US010804604B2

(12) United States Patent
Ling

(10) Patent No.: US 10,804,604 B2
(45) Date of Patent: Oct. 13, 2020

(54) CALIBRATION IN A PHASED ARRAY SYSTEM

(71) Applicant: Maxlinear, Inc., Carlsbad, CA (US)

(72) Inventor: Curtis Ling, Carlsbad, CA (US)

(73) Assignee: MaxLinear, Inc., Carlsbad, CA (US)

( * ) Notice: Subject to any disclaimer, the term of this patent is extended or adjusted under 35 U.S.C. 154(b) by 8 days.

(21) Appl. No.: 16/372,569

(22) Filed: Apr. 2, 2019

(65) Prior Publication Data

US 2019/0305419 A1 Oct. 3, 2019

Related U.S. Application Data

(60) Provisional application No. 62/651,327, filed on Apr. 2, 2018.

(51) Int. Cl.
*H01Q 21/06* (2006.01)
*H01Q 3/24* (2006.01)
*H01Q 21/22* (2006.01)

(52) U.S. Cl.
CPC ..... *H01Q 3/24* (2013.01); *H01Q 21/061* (2013.01); *H01Q 21/22* (2013.01)

(58) Field of Classification Search
CPC ..... H01Q 3/34; H01Q 21/22; H01Q 21/061; H01Q 3/267
See application file for complete search history.

(56) References Cited

U.S. PATENT DOCUMENTS 9,768,852 B2 9/2017 Ling et al.
9,825,694 B2 11/2017 Gallagher et al.
10,103,822 B2 10/2018 Ling et al.
10,516,591 B2 * 12/2019 Brouillette ..... H04L 65/80
2018/0359018 A1 * 12/2018 Ling ..... H04B 7/086
2019/0157756 A1 5/2019 Ling
2019/0267707 A1 * 8/2019 Khalil ..... H01Q 21/22
2019/0305417 A1 * 10/2019 Ling ..... H01Q 3/40
2019/0305419 A1 * 10/2019 Ling ..... H01Q 3/34
2019/0305438 A1 * 10/2019 Ling ..... H01Q 3/2605
2019/0305999 A1 * 10/2019 Ling ..... G01S 13/89
2020/0052771 A1 * 2/2020 Ling ..... H04B 7/0408

OTHER PUBLICATIONS

U.S. Appl. No. 16/372,572, filed Apr. 2, 2019.
U.S. Appl. No. 16/372,577, filed Apr. 2, 2019.

* cited by examiner

*Primary Examiner* — Dameon E Levi
*Assistant Examiner* — David E Lotter
(74) *Attorney, Agent, or Firm* — Maschoff Brennan

(57) ABSTRACT

A system comprises a plurality of antenna elements, a transmitter circuit, and first and second receiver circuits. The transmitter is operable to: transmit, via a first antenna element, a series of signals having a calibration component and each of the signals being generated with a different configuration of the transmitter circuit; and select a configuration for a future transmission based on a signal metric. The first receiver circuit is operable to: receive the signal via a second antenna element; and detect the calibration component in the signal to generate a first calibration signal. The second receiver circuit is operable to: receive the signal via a third antenna element; detect the calibration component in the signal to generate a second calibration signal; combine the first and second calibration signals to generate a combined calibration signal; and generate the signal metric based on the combined calibration signal.

20 Claims, 11 Drawing Sheets

CALIBRATION IN A PHASED ARRAY SYSTEM

PRIORITY CLAIM

This application claims priority to U.S. provisional application 62/651,327 titled "Calibration in A Phased Array with Integrated Circulator" and filed on Apr. 2, 2018, which is hereby incorporated herein by reference in its entirety.

BACKGROUND

Limitations and disadvantages of conventional approaches to phased array systems will become apparent to one of skill in the art, through comparison of such approaches with some aspects of the present method and system set forth in the remainder of this disclosure with reference to the drawings.

BRIEF SUMMARY

Methods and systems are provided for calibration in a phased array system, substantially as illustrated by and/or described in connection with at least one of the figures, as set forth more completely in the claims.

DETAILED DESCRIPTION

Figure 1A:
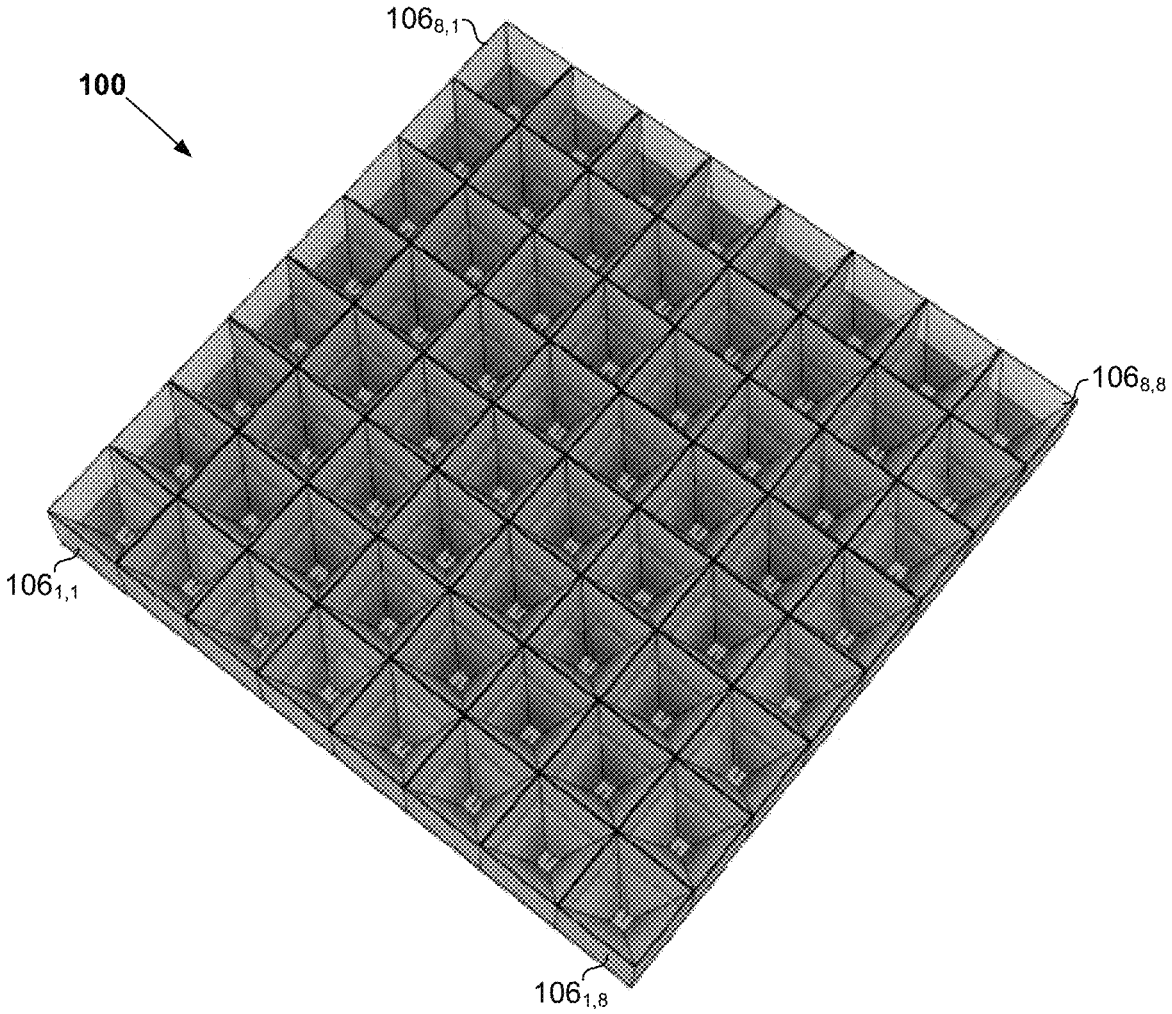
FIG. 1A shows a front view of an example phased array transceiver system.
Figure 1B:
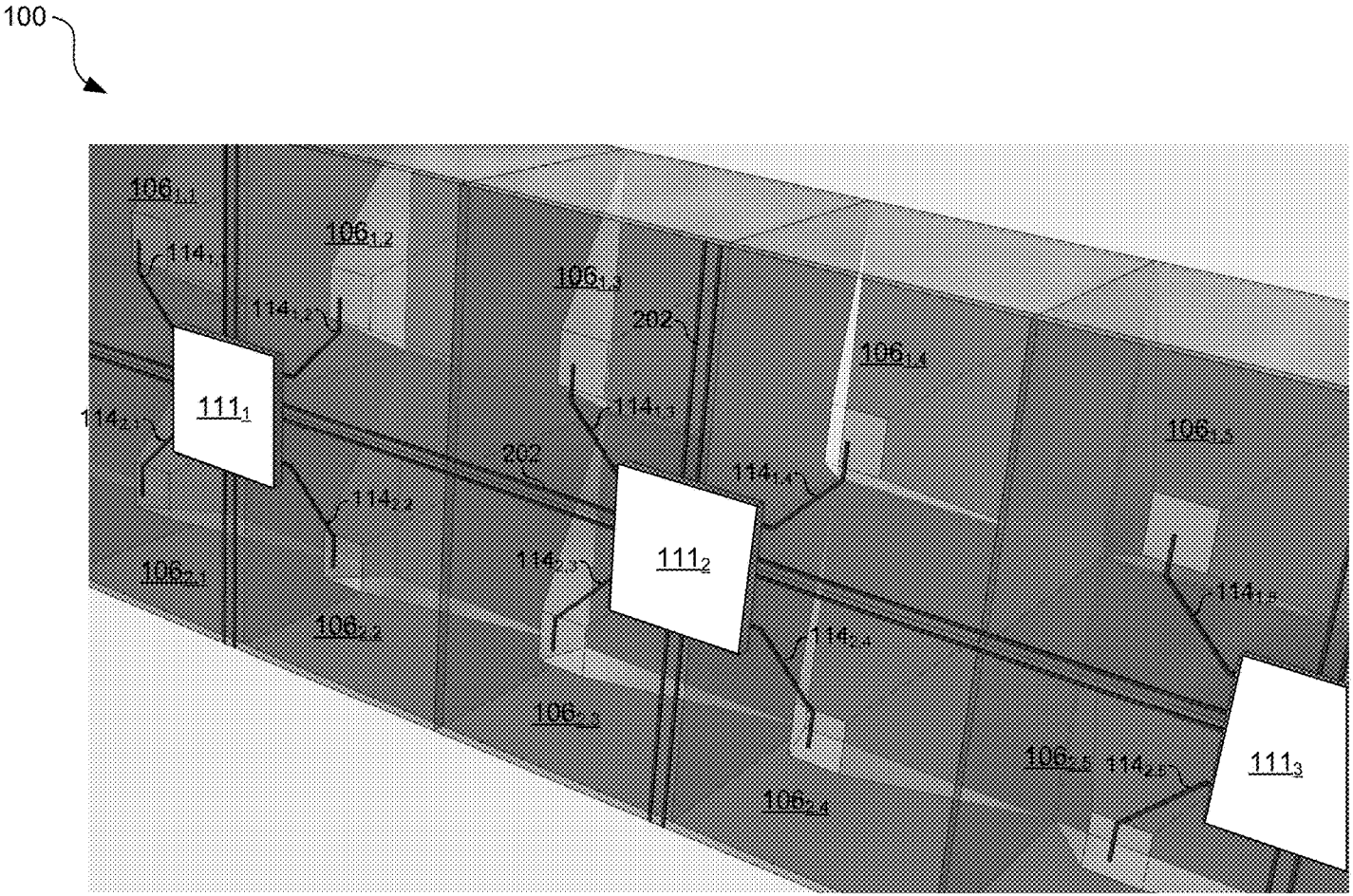
FIG. 1B shows a rear view of an example phased array transceiver system.
Figure 1C:
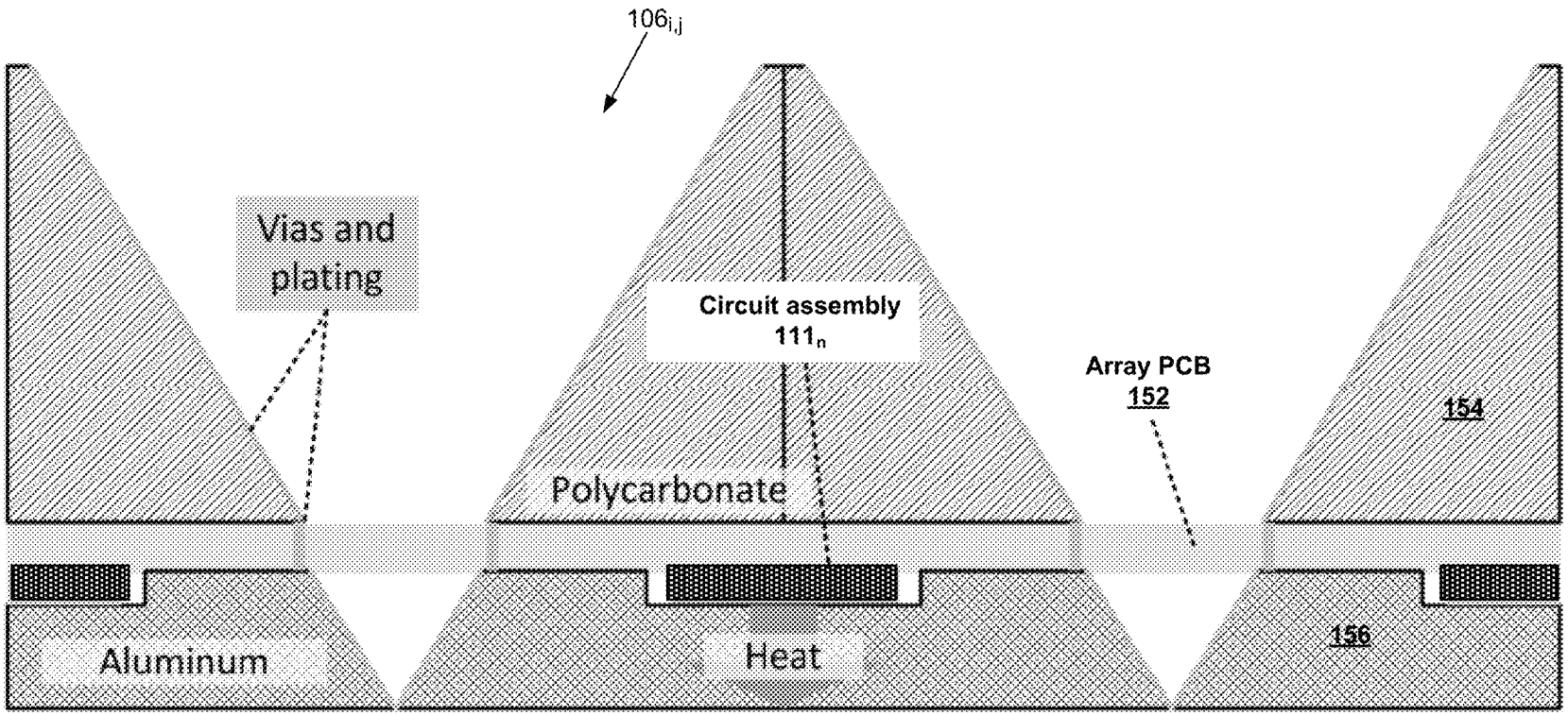
FIG. 1C shows a cross-sectional view of an example phased array transceiver system.

FIG. 1A-1C illustrate an example phased array system 100. FIG. 1A shows a front view and FIG. 1B shows a rear view.

The phased array system 100 comprises a plurality of antenna element elements arranged in a 2-dimensional array. Each antenna element is called out as $\mathbf{106}_{i,j}$, where i is an integer corresponding to the antenna element's row index in the array (0<=i<=I) and j is an integer corresponding to the antenna element's column index in the array (0<=j<=J). In the example shown there are 8 antenna elements in each row and 8 antenna elements in each column, (i.e., I=8 and J=8), but in practice any number of antenna elements may be used. The transmission and reception of signals by the system 100 may take advantage of beamforming, and may be particularly configured for addressing possible issues (interference, etc.) and/or to provide added features, as described below.

The example phased array system 100 of FIGS. 1A-1C comprises an array of antenna elements $\mathbf{106}_{i,j}$ (e.g., 64 elements in and 8×8 arrangement in the non-limiting example implementation illustrated in FIG. 1A), and one or more circuit assemblies 111 operable to transmit and/or receive signals via the array of antenna elements 106. The circuits 111 are operable to perform various signal processing related functions, as well as (optionally) other functions (e.g., control, storage, etc.) in support of the transmission and reception of signals via the antenna elements 106. In the example implementation shown, the system 100 comprises N (an integer) circuit assemblies $\mathbf{111}_n$ (1<=n<=N), each of which is operable to transmit and/or receive via a respective M (an integer) of the antenna elements 106 (N=16 and M=4 in the example shown).

Antenna elements 106, of which two elements are shown in the cross-section slice depicted in FIG. 1C, may be formed using carved horn structure 154, which may comprise a polycarbonate (or other suitable material) substrate with conductive plating (e.g., aluminum) covering the surfaces forming the horn-shaped antenna elements. The antenna elements 106 may be mounted to a rigid base structure 156 (e.g., made of aluminum). In between the base structure 156 and the horn structure 154 may be one or more printed circuit board (PCB) 152 that provides RF traces interconnecting the circuit assemblies 111 and the antenna elements 106.

Phased array systems, such as the phased array system 100, offer various advantages and/or improvements over conventional antenna systems, such as dish-based designs. For example, their light weight, small form factor, and ability to electronically steer the signal through beamforming p may give phased array systems an advantage over dish-based designs in some contexts. The lack of a bulky parabolic reflector and related components (e.g., the frequency duplexer, large power amplifier ("PA"), etc.) allows for installation at a wider range of sites, with lower cost of installation and operation (e.g., due to the ability to automatically and electronically align and re-align the antenna). Accordingly, phased array systems may be installed in a more flexible manner compared to dish-based systems, allowing installation options not possible or practical with traditional designs—e.g., mounting to sides of buildings, etc.

Phased array systems may have lower costs (e.g., fewer, smaller, and less expensive circuits, etc.). Also, the use of software-defined multiband array operation adds more flexibility. For example, the elimination of certain components (e.g., duplexers) allows phased array systems to operate across a wide frequency range, achieve greater link reach for the same antenna size (due to, e.g., greater transmitter power, interference suppression, etc.), and reduce costs (e.g., through lower operating and maintenance expenditures, greater frequency reuse, lower weight, etc.). Further, phased array systems may have superior thermal dissipation characteristics. In addition, the same core technology may be used for different interfaces and/or frequencies bands, allowing for common software and hardware development.

However, some issues may arise with phased arrays and use thereof. For example, one of the issues with phased arrays is the potential distortion caused by certain components, such as power amplifiers. In this regard, power amplifiers typically may be the last circuit and/or processing step in a transmit signal path, and characteristics of the power amplifiers may have important effects on the transmission of signals and quality thereof. For example, one such effect is the distortion that may be introduced by the power amplifiers during transmission of signals, such as because of certain characteristics (e.g., nonlinearity) in the power amplifiers. This may be particularly troublesome because power amplifier distortion in conventional phased arrays is co-directional with the desired signal. Thus, addressing power amplifier distortion may be desirable for improving performance in phased array systems.

Accordingly, in various implementations in accordance with the present disclosure, phased array systems may be configured to incorporate measures for mitigating power amplifier distortion. For example, systems in accordance with this disclosure may be configured to direct power amplifier distortion in a different direction from desired signal. For example, distortion components for all antenna elements may be directed in one direction different than the desired signals, or in different directions. Such redirecting of distortion may result in substantial improvement to spectral purity at the desired receiver.

In various implementations, distortion may be directed in a controlled fashion and may be pointed at an innocuous direction and/or spread out spatially over multiple directions, as desired. The redirection and/or spatial distribution of distortion may be adaptively controlled, such as to conform to required radiation pattern envelopes (e.g., such as mandated by the Federal Communications Commission and/or other regulatory bodies). In an example implementation, a distortion vector is variably rotated, with the rotation being continually changed based on some criteria, such as based on the antenna elements (e.g., the rotation change being implemented as a function of antenna index i which is used to uniquely identify each antenna element in the phased array). For example, rotation may be changed by introduction of an additional distortion vector, or other techniques. This is described in more detail below.

Figure 2A:
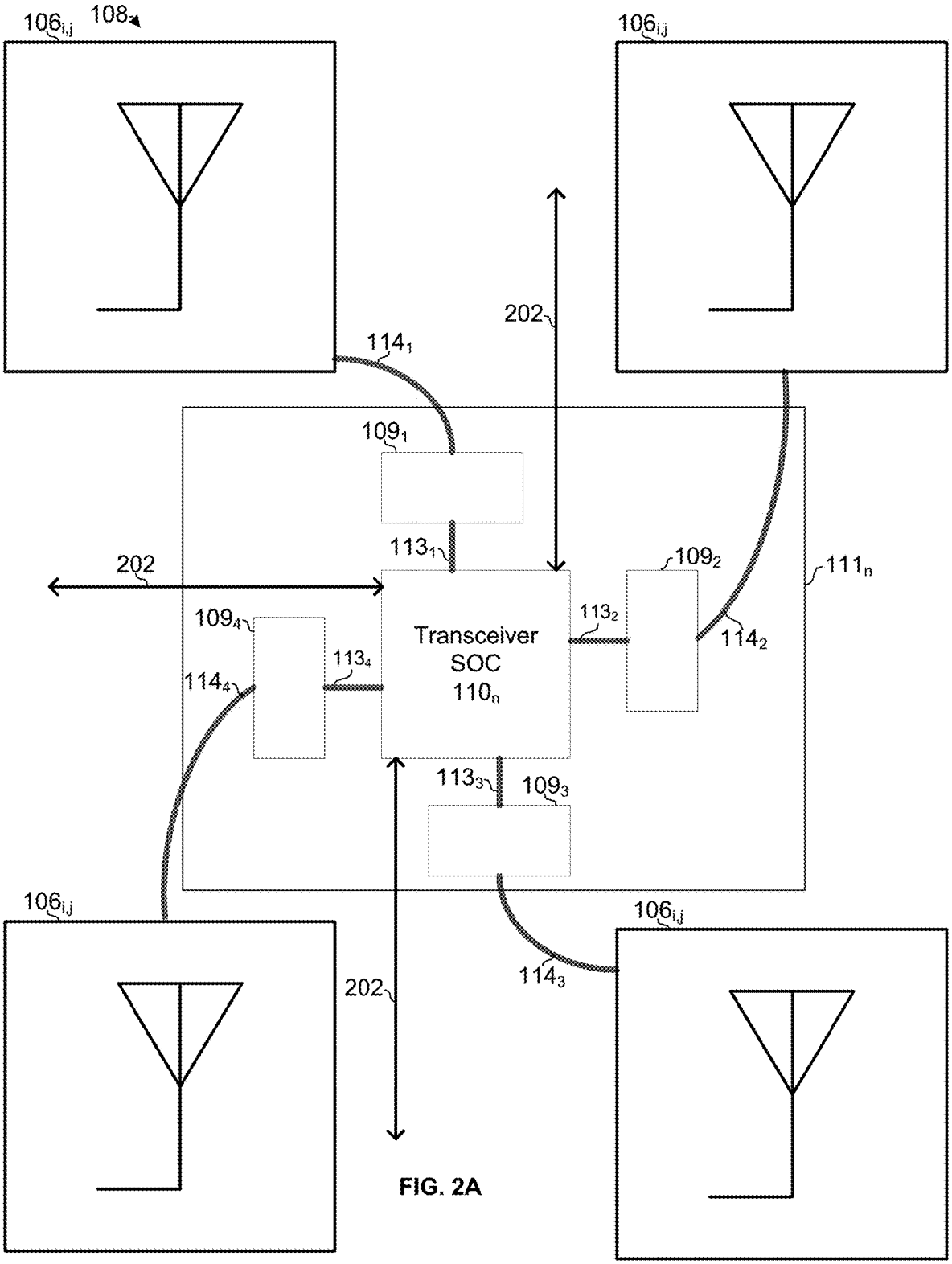
FIGS. 2A and 2B show an example board-level architecture of a phased array transceiver system.
Figure 2B:
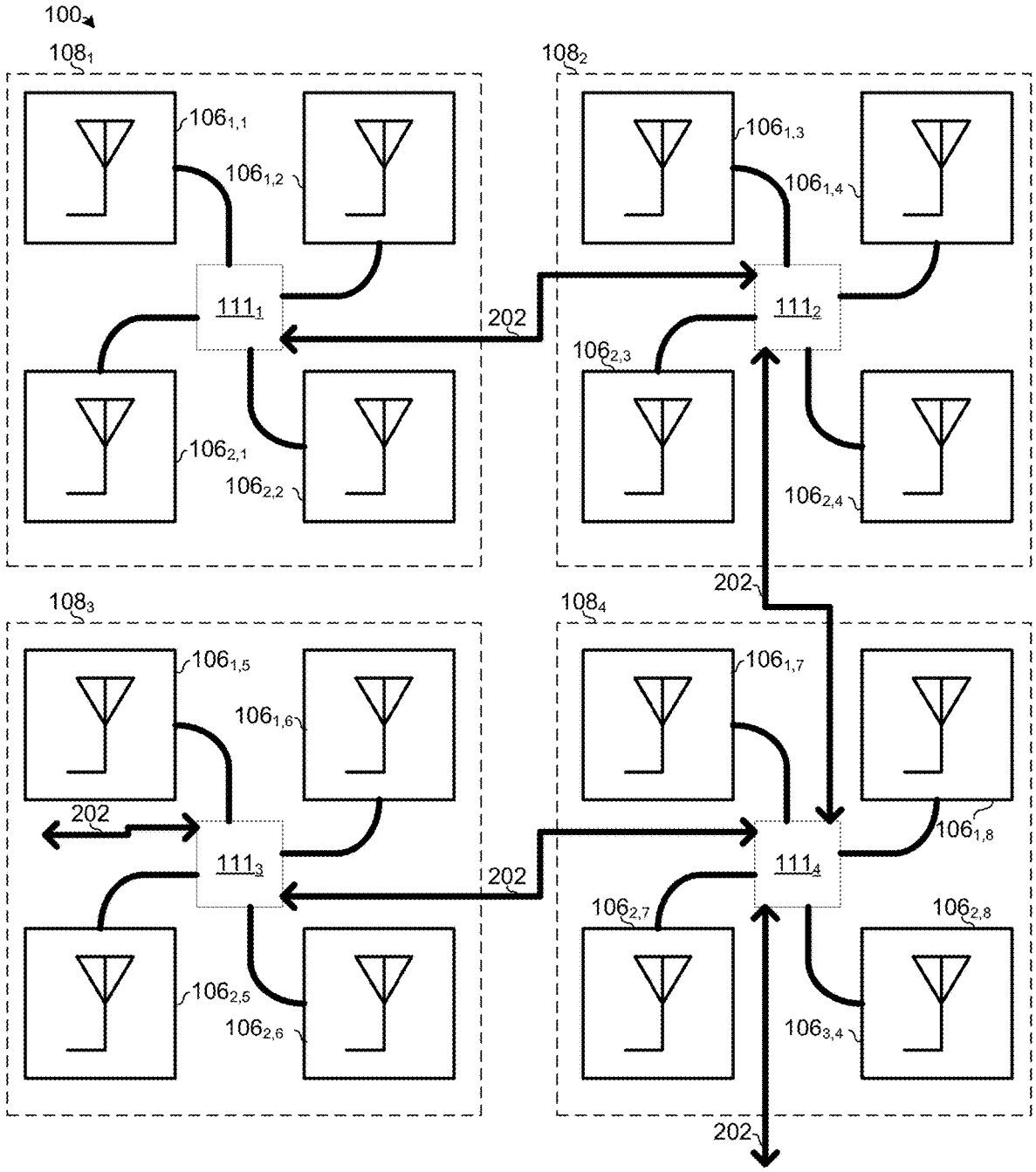

FIGS. 2A and 2B show an example board-level architecture of a phased array transceiver system. In the example implementation of FIGS. 2A and 2B, each circuit assembly $\mathbf{111}_a$ comprises a highly-integrated transceiver system on chip $\mathbf{110}_n$ and a plurality of off-chip circuits $\mathbf{109}_m$, each of the circuits $\mathbf{109}_m$ being associated with a respective one of the M antenna elements 106 via which the circuit assembly $\mathbf{110}_n$ transmits and/or receives. An example implementation of the SoC $\mathbf{110}_n$ is described below with reference to FIG. 3A. An example implementation of the circuits 109 is described below with reference to FIG. 3B. The N SoCs $\mathbf{110}_1$-$\mathbf{110}_N$ are interconnected via interconnect 202, which may, for example, comprise a high-speed serial bus via which the SoCs $\mathbf{110}_1$-$\mathbf{110}_N$ can exchange data and control signaling.

Figure 3A:
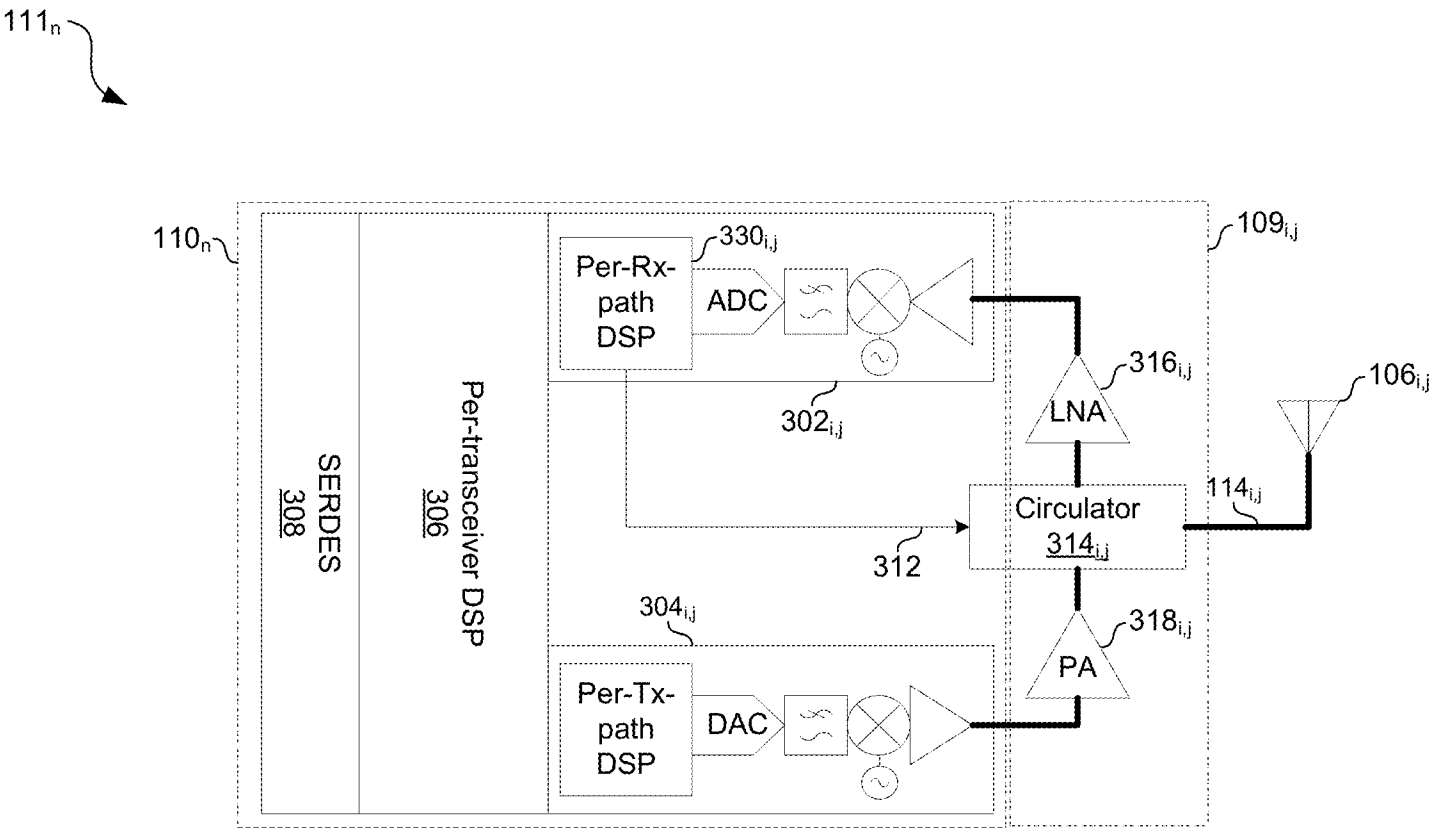
FIGS. 3A and 3B show an example chip-level architecture of a phased array transceiver system comprising integrated circulators.
Figure 3B:
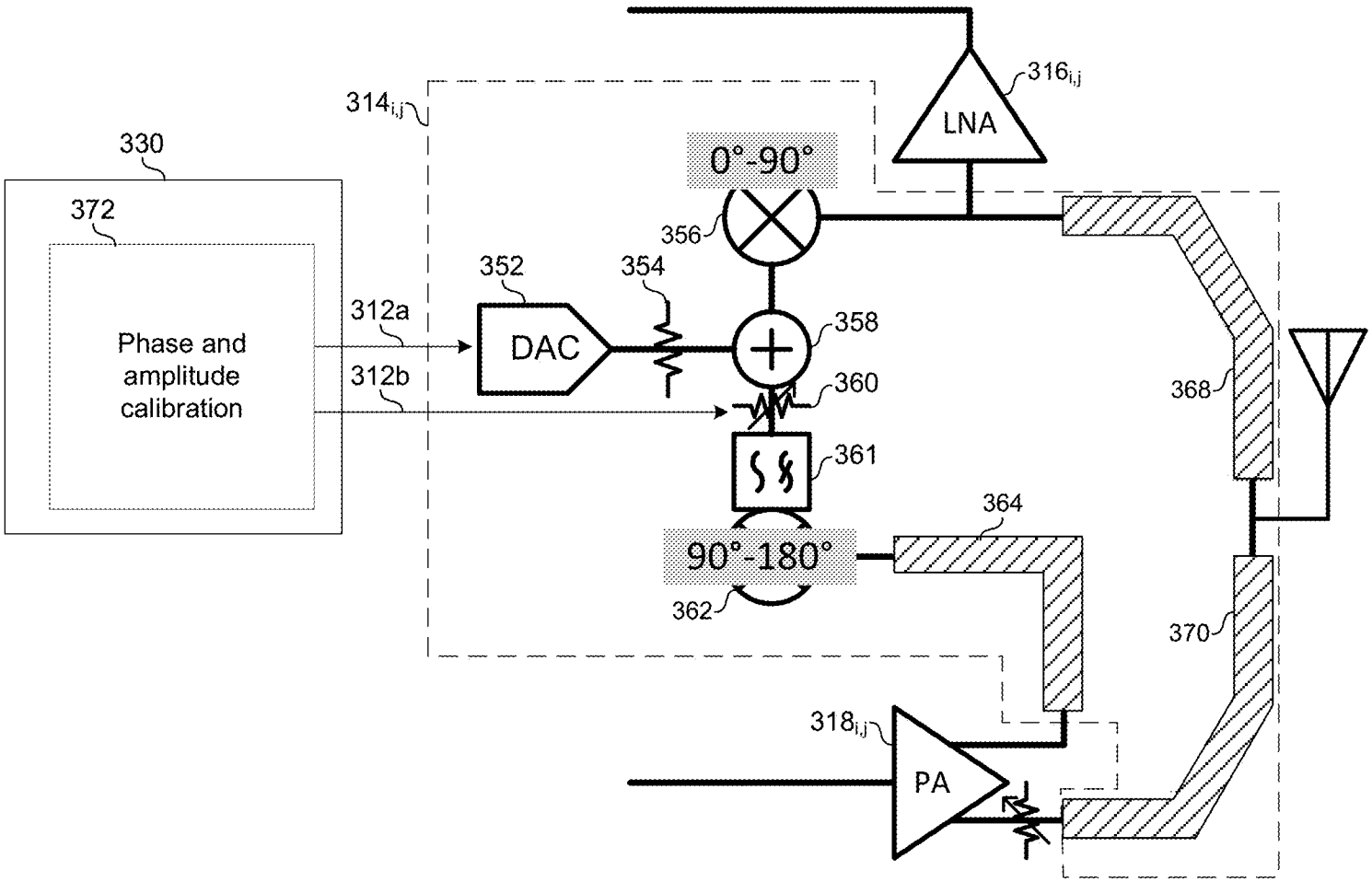

FIGS. 3A and 3B show an example chip-level architecture of a phased array transceiver system comprising integrated circulators. Referring to FIG. 3A, shown a circuit assembly comprising system-on-chip (SoC) $\mathbf{110}_n$, front-end circuit $\mathbf{109}_{i,j}$, and antenna element $\mathbf{106}_{i,j}$. In an example implementation, the SoC $\mathbf{110}_n$ is a CMOS device and the LNA $\mathbf{316}_{i,j}$ and PA $\mathbf{318}_{i,j}$ are PHEMT devices. In other example implementations, one or more of the circuits 109 may be integrated on the CMOS chip 110.

The example SoC $\mathbf{110}_n$ comprises serialization and deserialization (SERDES) circuitry 308, per-transceiver digital signal processing (DSP) circuitry 306, one or more receive front-end circuits $\mathbf{302}_{i,j}$, one or more transmit front-end circuits $\mathbf{304}_{i,j}$, and a portion of one or more (four, in an example implementation) circulator $\mathbf{314}_{i,j}$. Although only one receive front-end circuit $\mathbf{302}_{i,j}$ and one transmit front-end circuit $\mathbf{304}_{i,j}$ are shown for simplicity of illustration, the SoC $\mathbf{110}_n$ may comprise any number of instances of these circuits. In the example implementation FIG. 1B, for example, the SoC $\mathbf{110}_n$ may comprise four instances of receive front-end circuit $\mathbf{302}_{i,j}$—one for each of the four antenna elements $\mathbf{106}_{i,j}$ via which the SoC $\mathbf{110}_n$ receives, and four instances of transmit front-end circuit $\mathbf{304}_{i,j}$—one for each of the four antenna elements $\mathbf{106}_{i,j}$ via which the SoC $\mathbf{110}_n$ transmits.

The example circuit $\mathbf{109}_{i,j}$ comprises a low-noise amplifier $\mathbf{316}_{i,j}$, a power amplifier $\mathbf{318}_{i,j}$, and a portion of the circulator $\mathbf{314}_{i,j}$. Although only one circuit $\mathbf{109}_{i,j}$ is shown for simplicity of illustration, the circuit assembly $\mathbf{111}_n$ may comprise any number of instances of this circuits. In the example implementations of FIGS. 1A, 1B, 2A, and 2B, for example, the circuit assembly $\mathbf{111}_n$ may comprise four instances—one for each antenna $\mathbf{106}_{i,j}$ via which the circuit assembly $\mathbf{111}_n$ transmits and/or receives.

Referring to FIG. 3B, details of an example implementation of the circulator $\mathbf{314}_{i,j}$ are shown. The circulator comprises a digital to analog converter (DAC) 352, an attenuator 354, a combiner 358, mixers 356 and 362, filter 361, impedance 360, and quarter wavelength transmission lines 364, 368, and 370. The circulator operates such that, ideally, signals traveling clockwise from the output of PA $\mathbf{318}_{i,j}$ to the input of the LNA $\mathbf{316}_{i,j}$ (through transmission line 364 and the mixers 362 and 356), add destructively (are 180° out of phase) with signals traveling clockwise from the output of the PA $\mathbf{318}_{i,j}$ to the input of the LNA $\mathbf{316}_{i,j}$ (through transmission lines 370 and 368). In theory, then, the circulator $\mathbf{314}_{i,j}$ isolates the input of the LNA $\mathbf{318}_{i,j}$ from the output of the PA $\mathbf{318}_{i,j}$. In practice, however, non-idealities will lead to imperfect cancellation, and thus some leakage of the output of PA $\mathbf{318}_{i,j}$ to the input of LNA $\mathbf{318}_{i,j}$. Accordingly, the circulator $\mathbf{314}_{i,j}$ comprises control inputs 312*a* and 312*b* for adjusting the phase and amplitude of the signal traveling the clockwise path to achieve better cancellation at the LNA input. The circulator of FIG. 3B is just one example of a circulator. Aspects of this disclosure can be applied to any circuit exhibiting nonreciprocal phase.

Figure 4A:
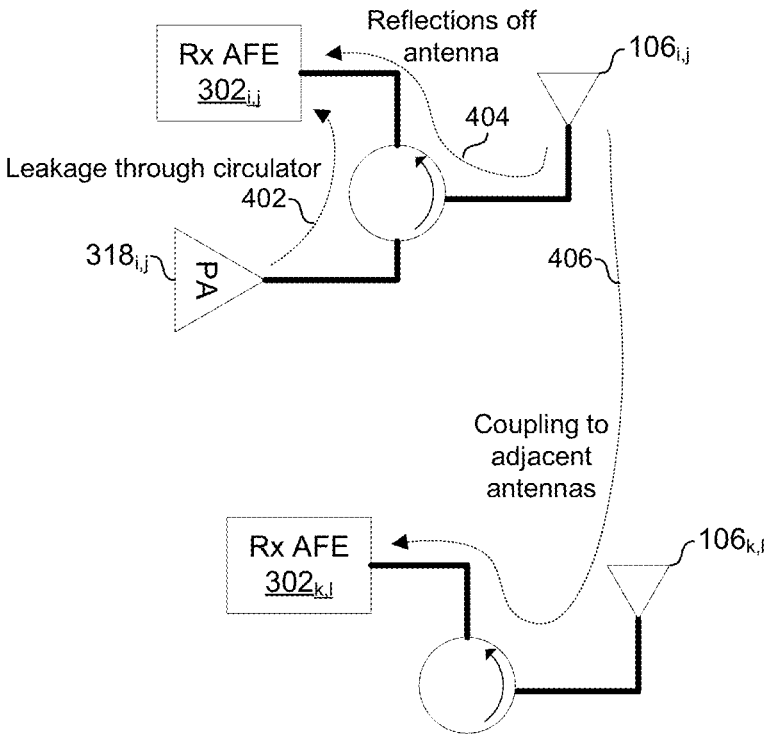
FIGS. 4A and 4B illustrate noise/interference in a phased array system with integrated circulators.
Figure 4B:
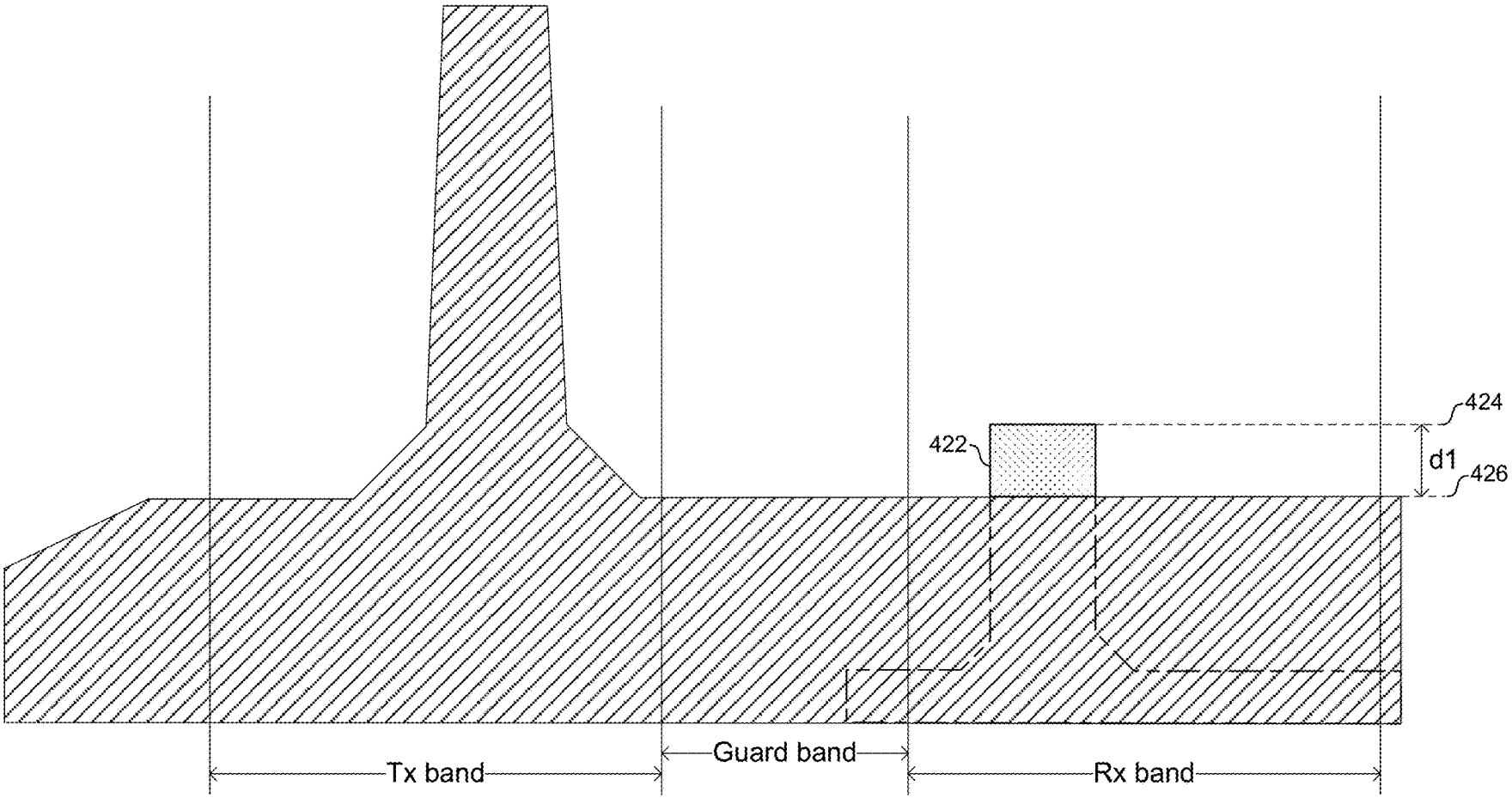

FIGS. 4A and 4B illustrate noise/interference in a phased array system with integrated circulators. Shown in FIG. 4A are various leakage paths. Arrow 402 represents leakage into receive circuit $\mathbf{302}_{i,j}$ due to imperfect isolation of the circulator $\mathbf{314}_{i,j}$. Arrow 404 represents leakage into receive chain $\mathbf{302}_{i,j}$ as a result of the transmitted signal reflecting back from antenna element $\mathbf{106}_{i,j}$ (due to imperfect impedance matching). Arrow 406 represents leakage into adjacent receive chain $\mathbf{302}_{k,l}$ due to the transmitted signal from antenna element $\mathbf{106}_{i,j}$, coupling into the antenna element $\mathbf{106}_{k,l}$. Because the received signals from the various antenna elements are summed during beamforming, all these leakage paths result in a net leakage in the received signal, which reduces the signal-to-noise ratio of the received signal, as will now be discussed with reference to FIG. 4B.

In the example of FIG. 4B, the phased array system transmits in a transmit band while simultaneously receiving in a receive band. Although the receive band is separated from the transmit band by a guard band, nonidealities (e.g., nonlinearity of the PA) may cause spectral regrowth of the transmit signal in the receive band to a level that could cause problems for signal reception if too much of the transmit signal leaks into the LNAs of the phased array system 100. Accordingly, phased array system 100 is operable to use the process of FIG. 5A to reduce leakage of transmitted signals into the receive paths.

Figure 5A:
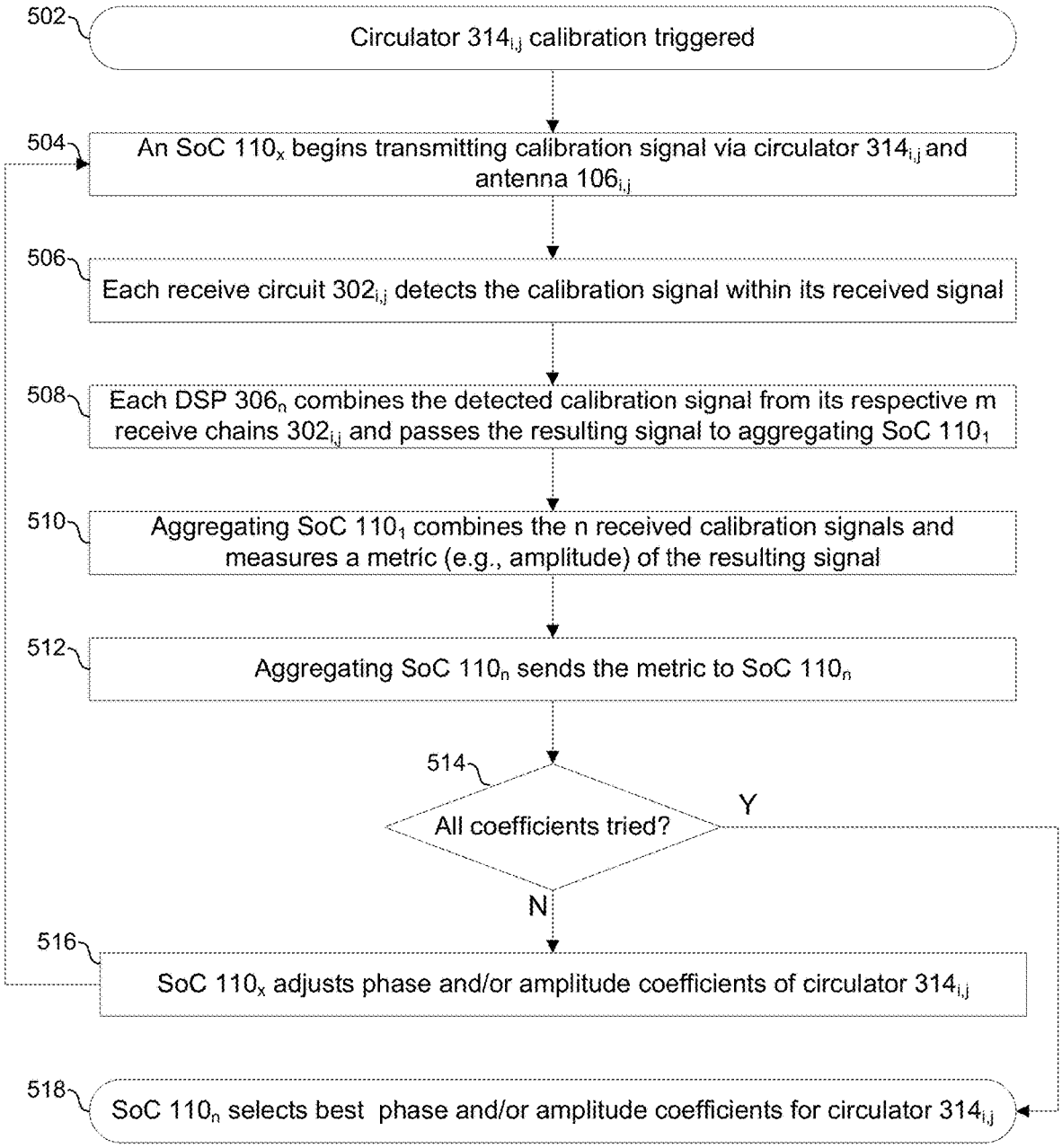
FIGS. 5A and 5B illustrate calibration of a phased array system with integrated circulators.
Figure 5B:
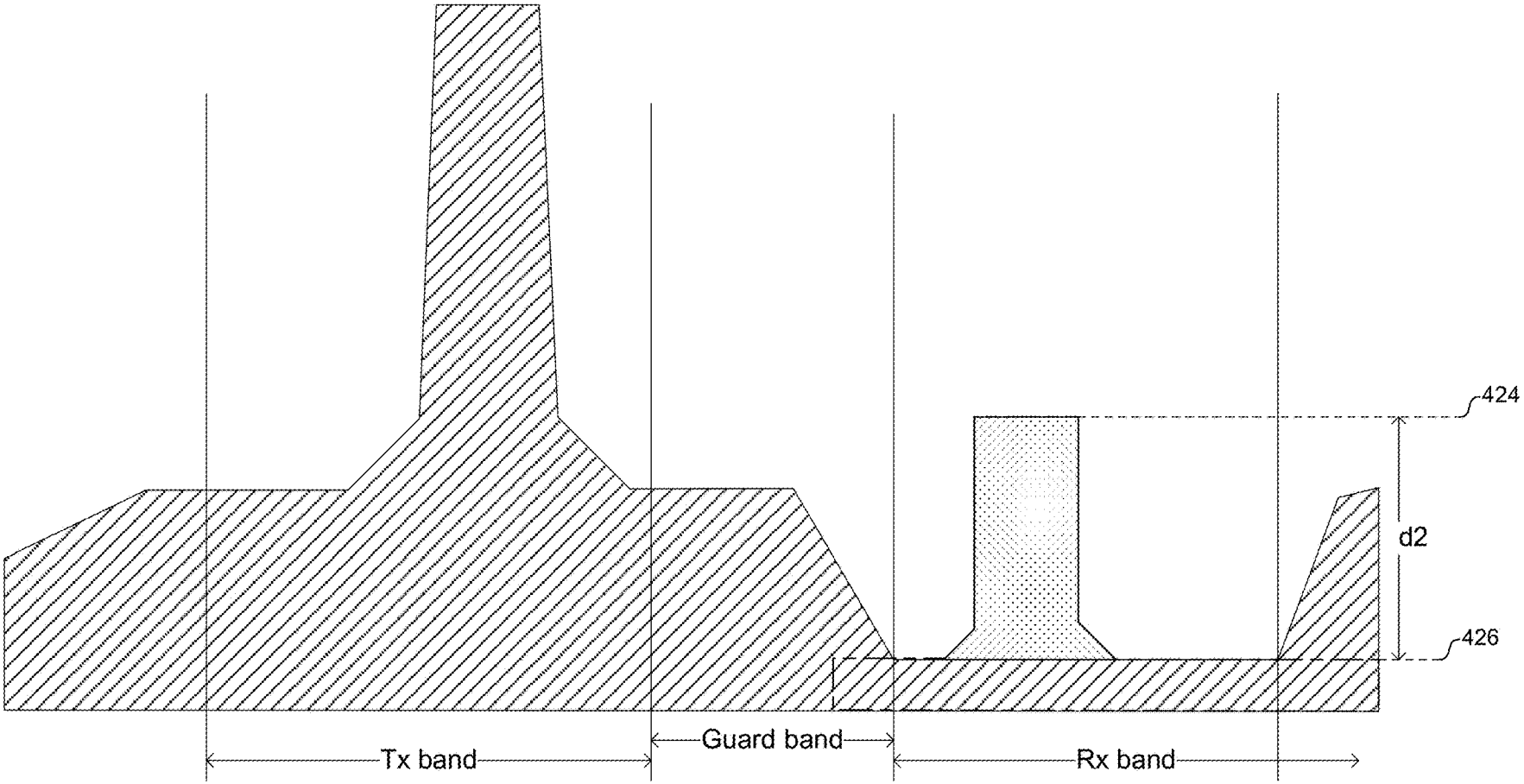

FIGS. 5A and 5B illustrate calibration of a phased array system with integrated circulators. Referring to FIG. 5A, a process for calibrating the circulators of a phased array system 100 begins in block 502 when calibration is triggered. This may occur, for example, during factory calibration, at power up of the phased array system 100, periodically during operation of the phased array system 100, and/or in response to a detected condition (e.g., such as a received signal error rate exceeding a threshold). After block 502, is block 504.

In block 504, an SoC $\mathbf{110}_n$ begins transmitting a calibration signal via PA $\mathbf{318}_{i,j}$, circulator $\mathbf{314}_{i,j}$, and antenna $\mathbf{106}_{i,j}$. In an example implementation, calibration takes place while the phased array system 100 is actively transmitting a data signal, and generation of the calibration signal comprises modulating the gain of the PA $\mathbf{318}_{i,j}$ at a level and frequency that does not critically impact the data signal. That is, the calibration signal is technically a distortion of the data signal, but the relatively low frequency of the calibration signal combined with the fact that the amplitude of the calibration signal is small (especially considering that the signal out of antenna $\mathbf{106}_{i,j}$, is only $1/(I*J)^{th}$ of the total signal power) means that a useful calibration signal can be transmitted while the quality of the overall transmitted signal remains within specification.

In block 506, each of the i*j receive circuits 302 of the phased array system 100 detects the calibration signal in its received signal.

In block 508, each of the DSP circuits $\mathbf{306}_1$-$\mathbf{306}_N$ combines (after applying beamforming coefficients) its m received calibration signals from its m receive circuits 302, and passes the resulting combined signal, via its SERDES circuit 308 and bus 202, to the one of the SoCs $\mathbf{110}_1$-$\mathbf{110}_N$ that has been designated as the aggregating node (for purposes of illustration it is assumed SoC $\mathbf{110}_1$ is designated as the aggregating node).

In block 510, the aggregating SoC $\mathbf{110}_1$ combines the n calibration signals received by itself and the other n−1 SoCs $\mathbf{110}_2$-$\mathbf{110}_N$, then processes the resulting signal to generate a metric (e.g., peak or RMS amplitude of the net leakage of the calibration signal transmitted via circulator $\mathbf{314}_{i,j}$.)

In block 512, the metric measured in block 510 is sent to the SoC $\mathbf{110}_n$ in which resides the circulator $\mathbf{314}_{i,j}$ via which the calibration signal was transmitted.

In block 514, if all possible combinations of phase and amplitude coefficients 312*a* and 312*b* have not been tried, the process advances to block 516. Otherwise, the process advances to block 518.

In block 516, phase and amplitude calibration circuitry 372 (e.g., part of per-path DSP circuit 3300 selects the next set of coefficients 312*a* and 312*b* to be tried for the circulator $\mathbf{314}_{i,j}$, and then the process returns to block 504.

In block 518, the phase and amplitude calibration circuitry 372 selects the set of coefficients 312*a* and 312 that resulted in the best (or at least acceptable) value of the metric.

As a result of the process of FIG. 5A, the transmit signal present in the receive band is reduced, as shown in FIG. 5B. That is, in FIG. 4B, without use of the technique of FIG. 5B, distance between the peak 424 of the desired received signal 422 and the level 426 of transmit signal leakage is d1, but in FIG. 5B, with use of the technique of FIG. 5A, the distance has increased to d2.

The process of FIG. 5B exhaustively searches all possible phase and amplitude coefficients 312*a* and 312*b*, which may be feasible due to the fact that there is a limited range of amplitudes and phases that need to be searched in order to reduce leakage to acceptable levels. Nevertheless, in another implementation, rather than searching all possible coefficient values and choosing the best pair of coefficients, the search may simply stop as soon as an acceptable pair of coefficients is found.

In accordance with an example implementation of this disclosure, a system comprises a phased-array comprising a plurality of antenna elements (e.g., $\mathbf{106}_{1,1}$-$\mathbf{106}_{8,8}$), a transmitter circuit (e.g., $\mathbf{304}_{1,1}$ and a portion of $\mathbf{109}_{1,1}$), a first receiver circuit (e.g., $\mathbf{304}_{1,2}$), and a second receiver circuit (e.g., $\mathbf{304}_{2,2}$). The transmitter circuit is operable to: transmit, via a first of the antenna elements (e.g., $\mathbf{106}_{1,1}$), a series of signals, each of the signals having a calibration component and each of the signals being generated with a different one of a plurality of configurations of the transmitter circuit; and select one of the configurations for a future transmission based on a signal metric (e.g., a measurement of leakage of transmit-band signals leaking into a receive band). The first receiver circuit is operable to: receive a first received version of the signal via a second of the antenna elements (e.g., $\mathbf{106}_{1,2}$); and detect the calibration component in the first received version of the signal to generate a first calibration signal. The second receiver circuit is operable to: receive a second received version of the signal via a third of the antenna elements (e.g., $\mathbf{106}_{2,2}$); detect the calibration component in the second received version of the signal to generate a second calibration signal; combine the first calibration signal and the second calibration signal to generate a combined calibration signal; and generate the signal metric based on the combined calibration signal. Each one of the signals may be generated by: a first modulation of a carrier wave by a data signal to generate an intermediate signal; and a second modulation of the intermediate signal by a calibration signal, such that the second modulation is technically a distortion of the data-carrying intermediate signal, but the frequency and/or amplitude of the calibration signal is such that the distortion is tolerable under expected channel conditions. The transmitter circuit may be operable to decide (e.g., in real time just before performing the modulation of the intermediate signal by the calibration signal) to add the calibration component to the series of signals in response to a detected condition (an alert from a receiver that an error rate has exceeded a threshold). Each of the configurations of the transmitter circuit may correspond to a different set of phase and/or amplitude coefficients used by the transmitter circuit. The phase and/or amplitude coefficients (e.g., 312*a* and 312*b*) may control the phase and/or amplitude of local oscillator signals generated in the transmitter circuit. The local oscillators signals may be part of a circulator circuit (e.g., $\mathbf{314}_{1,1}$) that couples the transmitter circuit to the first of the antenna elements. The first receiver circuit may be configured to apply first beamforming coefficients to the first received version of the signal before performance of the detection. The second receiver circuit may be configured to apply second beamforming coefficients to the second received version of the signal before performance of the detection. The first beamforming coefficients may be different than the second beamforming coefficients, and each may be determined based on the respective antenna element's location within the array (e.g., represented by indices i and j). The first receiver circuit and the second receiver circuit may reside on different integrated circuits (e.g., $\mathbf{111}_1$ and $\mathbf{111}_2$). The first receiver circuit may be operable to sending the first calibration signal to the second receiver circuit via a data bus (e.g., 202). The second receiver circuit may be operable to receive the first calibration signal via the data bus.

As utilized herein the terms "circuits" and "circuitry" refer to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z". As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled or not enabled (e.g., by a user-configurable setting, factory trim, etc.).

The present method and/or system may be realized in hardware, software, or a combination of hardware and software. The present methods and/or systems may be realized in a centralized fashion in at least one computing system, or in a distributed fashion in which different elements are spread across several interconnected computing systems. Any kind of computing system or other apparatus adapted for carrying out the methods described herein is suited. A typical combination of hardware and software may be a general-purpose computing system with a program or other code that, when being loaded and executed, configures the computing system into a special purpose computing system such that it carries out the methods described herein. Another typical implementation may comprise an application specific integrated circuit or chip. Some implementations may comprise a non-transitory machine-readable (e.g., computer readable) medium (e.g., FLASH drive, optical disk, magnetic storage disk, or the like) having stored thereon one or more lines of code executable by a machine, thereby causing the machine to perform processes as described herein.

While the present method and/or system has been described with reference to certain implementations, it will be understood by those skilled in the art that various changes may be made and equivalents may be substituted without departing from the scope of the present method and/or system. In addition, many modifications may be made to adapt a particular situation or material to the teachings of the present disclosure without departing from its scope. Therefore, it is intended that the present method and/or system not be limited to the particular implementations disclosed, but that the present method and/or system will include all implementations falling within the scope of the appended claims.

What is claimed is:

1. A system comprising:

a phased-array comprising a plurality of antenna elements, a transmitter circuit, a first receiver circuit, and a second receiver circuit, wherein:

the transmitter circuit is operable to:

transmit, via a first of the antenna elements, a series of signals, each signal of the signals having a calibration component and each of the signals being generated with a different one of a plurality of configurations of the transmitter circuit; and select one of the configurations for a future transmission based on a signal metric;

the first receiver circuit is operable to:

receive a first received version of the signal via a second of the antenna elements; and detect the calibration component in the first received version of the signal to generate a first calibration signal;

the second receiver circuit is operable to:

receive a second received version of the signal via a third of the antenna elements;

detect the calibration component in the second received version of the signal to generate a second calibration signal;

combine the first calibration signal and the second calibration signal to generate a combined calibration signal; and generate the signal metric based on the combined calibration signal.

2. The system of claim 1, wherein each one of the signals is generated by:

a first modulation of a carrier wave by a data signal to generate an intermediate signal; and a second modulation of the intermediate signal by a calibration signal.

3. The system of claim 1, wherein the transmitter circuit is operable to decide to add the calibration component to the series of signals in response to a detected condition.

4. The system of claim 3, wherein the detected condition is an alert from a receiver that an error rate has exceeded a threshold.

5. The system of claim 1, wherein each of the configurations corresponds to a different set of phase and/or amplitude coefficients used by the transmitter circuit.

6. The system of claim 5, wherein the phase and/or amplitude coefficients control the phase and/or amplitude of local oscillator signals generated in the transmitter circuit.

7. The system of claim 6, wherein the local oscillators signals are part of a circulator circuit that couples the transmitter circuit to the first of the antenna elements.

8. The system of claim 1, wherein:

the first receiver circuit is configured to apply first beamforming coefficients to the first received version of the signal before performance of the detection; and the second receiver circuit is configured to apply second beamforming coefficients to the second received version of the signal before performance of the detection;

the first beamforming coefficients are different than the second beamforming coefficients.

9. The system of claim 1, wherein:

the first receiver circuit and the second receiver circuit reside on different integrated circuits;

the first receiver circuit is operable to send the first calibration signal to the second receiver circuit via a data bus; and the second receiver circuit is operable to receive the first calibration signal via a data bus.

10. The system of claim 1, wherein the metric is a measure of leakage of transmit-band signals leaking into a receive band.

11. A method comprising:

transmitting, by a transmitter circuit via a first antenna element of a phased-array of antenna elements, a series of signals, each signal of the signals having a calibration component and each of the signals being generated with a different one of a plurality of configurations of the transmitter circuit;

for each signal of the series of signals:

receiving a first received version of the signal via a second antenna element of the phased-array and a second received version of the signal via a third antenna element of the phased array;

detecting, by a first receiver circuit, the calibration component in the first received version of the signal to generate a first calibration signal;

detecting, by a second receiver circuit, the calibration component in the second received version of the signal to generate a second calibration signal;

combining the first calibration signal and the second calibration signal to generate a combined calibration signal; and measuring a metric of the combined calibration signal; and selecting one of the configurations for future transmissions by the transmitter circuit, wherein the selecting is based on the measured metric.

12. The method of claim 11, comprising generating each one of the signals by:

modulating a carrier wave by a data signal to generate an intermediate signal; and modulating the intermediate signal by a calibration signal.

13. The method of claim 11, comprising deciding, by the transmitter circuit, to add the calibration component to the series of signals in response to a detected condition.

14. The method of claim 13, wherein the detected condition is an alert from a receiver that an error rate has exceeded a threshold.

15. The method of claim 11, wherein each of the configurations corresponds to a different set of phase and/or amplitude coefficients applied used by the transmitter circuit.

16. The method of claim 15, wherein the phase and/or amplitude coefficients control the phase and/or amplitude of local oscillator signals generated in the transmitter circuit.

17. The method of claim 16, wherein the local oscillators signals are part of a circulator circuit that couples the transmitter circuit to the first of the antenna elements.

18. The method of claim 11, wherein:

the first receiver circuit applies first beamforming coefficients to the first received version of the signal before performing the detecting; and the second receiver circuit applies second beamforming coefficients to the second received version of the signal before performing the detecting;

the first beamforming coefficients are different than the second beamforming coefficients.

19. The method of claim 11, wherein:

the first receiver circuit and the second receiver circuit reside on different integrated circuits;

the combining is performed by the second receiver circuit; and the method comprises the first receiver circuit sending the first calibration signal to the second receiver circuit via a data bus.

20. The method of claim 11, wherein the metric is a measure of leakage of transmit-band signals leaking into a receive band.

* * * * *